US012295537B2

(12) United States Patent
Hong et al.

(10) Patent No.: US 12,295,537 B2
(45) Date of Patent: May 13, 2025

(54) ROBOT CLEANER WITH ASCENDING/DESCENDING GUIDES

(71) Applicant: LG ELECTRONICS INC., Seoul (KR)

(72) Inventors: Woo Hong, Seoul (KR); Sangik Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 305 days.

(21) Appl. No.: 17/914,543

(22) PCT Filed: Nov. 3, 2020

(86) PCT No.: PCT/KR2020/015185
§ 371 (c)(1),
(2) Date: Sep. 26, 2022

(87) PCT Pub. No.: WO2021/201364
PCT Pub. Date: Oct. 7, 2021

(65) Prior Publication Data

US 2023/0146907 A1 May 11, 2023

(30) Foreign Application Priority Data

Apr. 1, 2020 (KR) ..... 10-2020-0039960

(51) Int. Cl.
*A47L 9/04* (2006.01)
*A47L 9/28* (2006.01)

(52) U.S. Cl.
CPC ..... *A47L 9/0494* (2013.01); *A47L 9/0405* (2013.01); *A47L 9/0477* (2013.01); *A47L 9/2852* (2013.01);
(Continued)

(58) Field of Classification Search
CPC .... A47L 9/0494; A47L 9/0633; A47L 9/2852; A47L 5/34; A47L 2201/00; A47L 2201/04; A47L 2201/06
See application file for complete search history.

(56) References Cited

U.S. PATENT DOCUMENTS 7,448,113 B2 11/2008 Jones et al.
8,881,339 B2 11/2014 Gilbert, Jr. et al.

FOREIGN PATENT DOCUMENTS

CN 206687670 U 12/2017
CN 109162501 A 1/2019
(Continued)

*Primary Examiner* — C. A. Rivera
(74) *Attorney, Agent, or Firm* — Birch, Stewart, Kolasch & Birch, LLP

(57) ABSTRACT

The present invention relates to a robot cleaner. The robot cleaner comprises: a cleaner body equipped with a driving wheel; and a cleaning nozzle mounted inside a downwardly open opening portion in a lower portion of the cleaner body so as to be able to ascend and descend. The cleaning nozzle can be supported by a plurality of ascending/descending guides and a plurality of auxiliary ascending/descending guides so that the cleaning nozzle can ascend and descend relative to the cleaner body according to changes in the height of a cleaning surface on which the cleaner body travels. Accordingly, the cleaning to nozzle rises upon being pressed by a compressible floor such as a carpet, thus solving the problem of the cleaning nozzle catching on the cleaning surface. Therefore, travel performance can be improved, and the load on a brush driving part can be reduced.

22 Claims, 9 Drawing Sheets

(52) U.S. Cl.
CPC ..... *A47L 2201/04* (2013.01); *A47L 2201/06* (2013.01)

(56) References Cited

FOREIGN PATENT DOCUMENTS

| | | | | | |
|---|---|---|---|---|---|
| KR | 10-2004-0100143 | A | | 12/2004 | |
| KR | 10-0507928 | B1 | | 8/2005 | |
| KR | 10-2006-0038797 | A | | 5/2006 | |
| KR | 10-2008-0043641 | A | | 5/2008 | |
| KR | 20130107642 | A | * | 10/2013 | |
| KR | 10-1352287 | B1 | | 1/2014 | |
| KR | 10-2016-0025392 | A | | 3/2016 | |
| KR | 10-2017-0099627 | A | | 9/2017 | |
| KR | 10-1932045 | B1 | | 12/2018 | |
| WO | WO-2016032257 | A1 | * | 3/2016 | ..... A47L 9/00 |
| WO | WO 2018/136545 | A1 | | 7/2018 | |

* cited by examiner

ROBOT CLEANER WITH ASCENDING/DESCENDING GUIDES

CROSS REFERENCE TO RELATED APPLICATIONS

This application is the National Phase of PCT International Application No. PCT/KR2020/015185, filed on Nov. 3, 2020, which claims priority under 35 U.S.C. 119 (a) to Patent Application No. 10-2020-0039960, filed in the Republic of Korea on Apr. 1, 2020, all of which are hereby expressly incorporated by reference into the present application.

TECHNICAL FIELD

The present disclosure relates to a robot cleaner capable of actively moving regardless of a floor surface change with a great height difference.

BACKGROUND ART

A robot cleaner performs a vacuum cleaning function of sucking dust and foreign materials on a floor or a mopping function of mopping a floor while autonomously traveling in a certain area.

The robot cleaner generally includes a rechargeable battery and an obstacle detection sensor configured to avoid an obstacle during traveling to perform cleaning while autonomously traveling.

A cleaning nozzle used in the robot cleaner or a vacuum cleaner is adhered to a floor surface to suck foreign materials on a floor in a traveling path into the cleaning nozzle.

However, in a case of a cleaning nozzle in the related art, while a robot cleaner is traveling in different floor environments, a phenomenon in which a nozzle unit is caught on a boundary line between a hard floor and a soft floor (e.g., a carpet, a rug, etc.) due to a height difference between the soft and hard floors may occur.

In addition, when a robot cleaner travels on a carpet, etc., as great resistance may occur due to friction between the carpet and a brush, problems such that a driving load and a load on a driving motor configured to drive the brush increase, and allowable cleaning time decreases due to an increase in power consumption of the driving motor of the brush occurs.

To solve these problems, a suction structure of a robot cleaner is disclosed in KR 10-2017-0099627 A (published in Sep. 1, 2017: hereinafter, referred to as a patent document 1).

The robot cleaner disclosed in the patent document 1 includes a suction unit configured to suck foreign materials according to rotation of a brush, and a support portion provided to protrude from a side of the suction unit and configured to support the suction unit to ascend or descend.

However, the support portion disclosed in the patent document 1 is provided on a lower surface of a cleaner body and arranged to adhere to a floor surface. Thus, a problem such that foreign materials on the floor surface may be caught in the support portion is present.

In addition, WO 2016/032257 A I (published on Mar. 3, 2016; hereinafter, referred to as a patent document 2) discloses a suction nozzle, a robot cleaner, and a method of controlling the same.

The robot cleaner disclosed in the patent document 2 is installed in a lower portion of a main body to be movable in an upward/downward direction to move upwardly or downwardly along a surface to be cleaned, and includes a suction nozzle configured to use a main brush to sweep and suck free particles present in the surface to be cleaned.

However, in the patent document 2, a connection part connects the suction nozzle to a cleaner body such that the suction nozzle may move relative to the cleaner body in an upward/downward direction, and as the connection part is located in a lower portion of the cleaner body, a problem such that foreign materials on a floor surface may be caught in the connection part is present.

In addition, U.S. Pat. No. 7,448,113 B2 (published on Nov. 11, 2008: patent document 3) discloses an autonomous traveling robot cleaner.

A cleaning head disclosed in the patent document 3 includes a deck rotatably hinged to a housing. The deck accommodating a brush is raised relative to the housing by a deck adjusting assembly, according to an increase in a torque of the brush.

However, in a case of the deck adjusting assembly disclosed in patent document 3, a problem such that a structure of a link connecting the deck to the housing is very complicated is present.

In addition, U.S. Pat. No. 8,881,339 B2 (published on Nov. 11, 2014: patent document 4) discloses a robot cleaner.

A cleaning assembly (a cleaning head) disclosed in the patent document 4 is configured to be raised from a cleaning surface by a link when the robot cleaner moves from a hard surface to a compressible surface.

However, in the patent document 4, a problem such that a link connecting the cleaning assembly to a main body has a complicated structure is present.

DISCLOSURE OF INVENTION

Technical Problem

Therefore, to obviate those problems, an aspect of the detailed description is to provide a robot cleaner including a cleaning nozzle such that travel performance may be improved and allowable cleaning time may be extended by reducing a load on a brush driving part, by minimizing a phenomenon in which the cleaning nozzle is caught on a compressible floor surface when a traveling location changes from a hard floor to a compressible floor.

Another aspect of the detailed description is to provide a robot cleaner including a cleaning nozzle such that introduction of foreign materials may be minimized by using a link for an ascending/descending operation of the cleaning nozzle, and a simple structure is provided.

Another aspect of the detailed description is to provide a robot cleaner including a cleaning nozzle such that twisting is prevented during vertical ascending/descending of the cleaning nozzle.

Another aspect of the detailed description is to provide a robot cleaner including a cleaning nozzle such that a shape of a flow path may be constantly maintained during ascending/descending of the cleaning nozzle even when a suction flow path connected between the cleaning nozzle and a cleaner body is moving.

Solution to Problem

To achieve these and other advantages and in accordance with the purpose of the present invention, as embodied and broadly described herein, there is provided a robot cleaner including: a cleaner body equipped with a control unit and a driving wheel of which driving is controlled by the control unit; a cleaning nozzle mounted inside an opening portion opening downwardly in a lower portion of the cleaner body, and configured to ascend or descend relative to the cleaner body according to changes in a height of a cleaning surface on which the cleaner body travels; a plurality of ascending/descending guides included in the cleaning nozzle and configured to guide the ascending or the descending of the cleaning nozzle; and a plurality of support portions included in the cleaner body and configured to support the plurality of ascending/descending guides, respectively, so that the plurality of ascending/descending guides pass through the plurality of support portions, respectively, and move in an upward or downward direction.

In this configuration, the cleaning nozzle rises relative to the cleaner body upon being pressed due to a height of a compressible floor surface such as a carpet, thus solving a problem of the cleaning nozzle being caught on a cleaning surface, and enhancing travel performance.

The robot cleaner may further include catching hooks provided to protrude from upper end portions of the plurality of ascending/descending guides, respectively, and be caught on the plurality of support portions, respectively, when a plurality of ascending/descending guides descend such that the cleaning nozzle is hung onto an upper portion of the cleaner body.

In this configuration, the ascending/descending guides may be configured to guide the ascending or the descending of the cleaning nozzle, and accommodated in the cleaner body and supported in a form of being hung onto an upper portion in the cleaner body. Thus, introduction of dust, foreign materials, etc. may be minimized and a simple structure of the ascending/descending guides may be provided.

The robot cleaner may further include: a plurality of auxiliary ascending/descending guides included in the cleaning nozzle to be arranged below the plurality of ascending/descending guides, and configured to guide vertical ascending or descending of the cleaning nozzle; and a plurality of guide accommodation units included in the cleaner body, be in face-contact with both side surfaces of the plurality of auxiliary ascending/descending guides, and configured to guide vertical ascending or descending of the plurality of auxiliary ascending/descending guides.

In this configuration, the auxiliary ascending/descending guides may guide an ascending or descending operation of the cleaning nozzle vertically to prevent twisting during the ascending or the descending of the cleaning nozzle.

The cleaning nozzle may include a brush accommodation unit configured to accommodate a brush module, and the plurality of auxiliary ascending/descending guides may be provided to protrude from an upper portion of the brush accommodation unit.

The cleaning nozzle may include a brush module, and the plurality of ascending/descending guides may be provided protrude from front and rear portions of the cleaning nozzle in an upward direction, respectively, with the brush module interposed therebetween.

The cleaning nozzle may include: a nozzle base including a suction inlet communicating with the opening portion, and including shaft support portions at both ends of the nozzle base, respectively, wherein the shaft support portions rotatably support a brush module exposed via the suction inlet in a downward direction; and a nozzle cover coupled to an upper portion of the nozzle base to cover the brush module.

The nozzle cover may include: a brush accommodation unit configured to cover and accommodate the brush module in a circumferential direction; and a flange unit extending along an edge of the brush accommodating unit and coupled to the nozzle base, wherein the plurality of ascending/descending guides are provided to protrude from an upper surface of the flange unit, and arranged spaced apart from each other in a forward/backward direction of the brush accommodation unit.

The plurality of ascending/descending guides may be provided at left and right sides of the cleaning nozzle, respectively, and configured to guide end portions of the left and right sides of the cleaning nozzle to independently ascend or descend.

The robot cleaner may further include a nozzle accommodation unit installed in the cleaner body to cover the cleaning nozzle and configured to accommodate the cleaning nozzle, wherein the plurality of support portions are provided in the nozzle accommodation unit to be penetrated in an upward/downward direction so that the plurality of support portions are penetrated by the plurality of ascending/descending guides in an upward direction, respectively.

The nozzle cover may include: a brush accommodation unit configured to cover and accommodate the brush module in a circumferential direction; a flange unit extending along an edge of the brush accommodating unit and coupled to the nozzle base; and auxiliary ascending/descending guides arranged below the plurality of ascending/descending guides, respectively, provided to protrude from a front surface of the flange unit, and configured to guide vertical ascending or descending of the cleaning nozzle.

The robot cleaner may further include a nozzle accommodation unit installed in the cleaner body to cover the cleaning nozzle and configured to accommodate the cleaning nozzle, wherein the guide accommodation units include guide grooves into which the plurality of auxiliary ascending/descending guides slide, and are provided to protrude from the nozzle accommodation unit, respectively, to cover the plurality of auxiliary ascending/descending guides.

The cleaning nozzle may include a brush module configured to sweep away foreign materials on the cleaning surface via the opening portion; a suction guide mounted to be inclined downwardly in a lower portion of the nozzle base, and configured to receive and raise foreign materials swept away by the brush module; and a suction guide holder coupled to a lower portion of the nozzle base to fix the suction guide, with the suction guide arranged between the lower portion of the nozzle base and the suction guide holder.

The robot cleaner may further includes: a nozzle accommodation unit installed in the cleaner body to cover the cleaning nozzle; a discharge outlet provided in a rear portion of the cleaning nozzle and configured to discharge foreign materials sucked via the opening portion; a communication part provided in a rear portion of the nozzle accommodation unit to communicate with the discharge outlet; and a suction flow path part configured to communicate the discharge outlet to the communication part, and including an elastic material to elastically support the cleaning nozzle so that the cleaning nozzle may ascend or descend.

In this configuration, the suction flow path may include an elastic material, so that a shape of a flow path may be constantly maintained during ascending/descending of the cleaning nozzle even when a suction flow path connected between the cleaning nozzle and the cleaner body is moving.

When the cleaning nozzle rises due to a height of the cleaning surface, the suction flow path part may elastically press the cleaning nozzle to an original position of the cleaning nozzle.

The suction flow path part may further include a fastening flange provided to protrude from an end portion of the suction flow path part in an outward direction along a circumferential direction and fastened to the communication part, wherein the suction flow path part extends to protrude toward a rear direction from the discharge outlet.

The cleaning nozzle may include: a brush accommodation unit configured to accommodate a brush module configured to sweep away foreign materials on the cleaning surface via the opening portion; and a brush driving part mounted in an end portion of one side of the brush accommodation unit, and configured to rotate the brush module.

The robot cleaner may further include a nozzle accommodation unit installed in the cleaner body to cover the cleaning nozzle and configured to accommodate the cleaning nozzle, wherein the nozzle accommodation unit further includes a through-portion penetrated by the brush driving part so that the brush driving part protruding from an end portion of the brush accommodation unit toward outside of the nozzle accommodation unit may ascend or descend with the cleaning nozzle.

The cleaning nozzle may include a suction flow path part extending to protrude from a discharge outlet of the brush accommodation unit in a rear direction to discharge the foreign materials, and configured to elastically support the cleaning nozzle to correct an asymmetric load on the brush driving part.

The suction flow path part may be provided in a form of a closed loop.

The suction flow path part may include an elastic material, and may further include a reinforcement portion provided such that a thickness is further increased along an inner circumference of a section of the suction flow path part, the section being close to the brush driving part.

The suction flow path part may include an elastic material, and may further include a plurality of reinforcement ribs arranged spaced apart from each other along a surface of an outer circumference of a section of the suction flow path part, the section being close to the brush driving part, and provided to protrude in an outward direction.

There is also provided a robot cleaner including: a cleaner body equipped with a control unit and a driving wheel of which driving is controlled by the control unit; a cleaning nozzle mounted inside an opening portion opening downwardly in a lower portion of the cleaner body, and configured to ascend or descend relative to the cleaner body according to changes in a height of a cleaning surface on which the cleaner body travels; a nozzle accommodation unit installed in the cleaner body to cover an upper portion of the cleaning nozzle; a brush module mounted to be accommodated in the cleaning nozzle; a brush driving part mounted in an end portion of one side of the cleaning nozzle and configured to drive the brush module; and a suction flow path part connecting the cleaning nozzle to the nozzle accommodation unit to suck foreign materials swept away by the brush module, and configured to elastically support the cleaning nozzle to ascend or descend and correct an asymmetric load on the brush driving part.

Advantageous Effects of Invention

Hereinafter, effects of a robot cleaner according to the present disclosure will be described.

In accordance with the detailed description, a plurality of ascending/descending guides may be provided in an upper portion of a cleaning nozzle to protrude in an upward direction. A plurality of support portions may be provided on an upper portion of a nozzle accommodation unit to be penetrated therethrough, the nozzle accommodation unit being configured to cover the upper portion of the cleaning nozzle. The ascending/descending guides pass through the support portions to be supported by the support portions to ascend or descend. Thus, the cleaning nozzle may ascend or descend from an opening portion opening downwardly in a low portion of the cleaner body, according to a height difference between floors. Accordingly, when a cleaner body moves from a hard floor surface to a compressible floor surface, a phenomenon in which the cleaning nozzle is caught on the compressible floor surface is minimized, and thus, travel performance may be improved. In addition, as a brush in a brush module rotates in a state of rising above the compressible floor surface, rotation resistance of the brush module may be reduced, and thus, a load on a brush driving part may be reduced. Power consumption of the brush driving part may be reduced, and thus, allowable cleaning time may be extended.

In addition, as catching hooks are provided to protrude from upper end portions of the ascending/descending guides and be caught on support portions, the cleaning nozzle may be supported in a state of being hung onto the upper portion of a nozzle accommodation unit in the cleaner body. Accordingly, the catching hooks may limit a lowest descending height of the cleaning nozzle.

Further, auxiliary ascending/descending guides may be provided to protrude from front and rear surfaces of the cleaning nozzle, respectively, to be arranged below the ascending/descending guides. The guide accommodation units may be provided to protrude from front and rear surface of the nozzle accommodation unit, respectively, in an outward direction, to be arranged below the support portions. The auxiliary ascending/descending guides may be slidably supported in an upward/downward direction along the guide grooves provided inside the guide accommodation unit. Accordingly, the auxiliary ascending/descending guides may slide upwardly or downwardly in a state of being accommodated in the guide accommodation unit, and thus, may stably support vertical ascending/descending of the cleaning nozzle. In addition, the auxiliary ascending/descending guides and the guide accommodation unit may prevent twisting during vertical ascending/descending of the cleaning nozzle.

Further, an upper end portion of the guide accommodation unit is provided to have a closed structure in which upper ends of the guide grooves are closed. Thus, when upper end portions of the auxiliary ascending/descending guides receive pressing force and rise due to a height of a floor, a maximum ascending height of the auxiliary ascending/descending guides may be limited due to the closed structure of the guide accommodation unit.

The ascending/descending guides and the auxiliary ascending/descending guides, each configured to guide an ascending/descending operation of the cleaning nozzle, may be arranged on an upper portion of the brush accommodation unit arranged in an upper inner portion of the cleaner body to minimize introduction of foreign materials. In addition, the support portions and the guide accommodation unit, each being configured to support the ascending/descending guides and the auxiliary ascending/descending guides to move upwardly or downwardly, have simple structures, respectively, and thus, may greatly contribute to miniaturization of the robot cleaner and cost reduction.

Additionally, the suction flow path part, configured to suck foreign materials, etc. swept away by the brush module, may extend to protrude from a rear portion of the cleaning nozzle to connect to the nozzle accommodation unit. The suction flow path part includes an elastic material, and may elastically support the cleaning nozzle configured to ascend/descend according to a height of a floor.

In addition, the brush driving part may be mounted in an end portion at one side of the cleaning nozzle to drive the brush module accommodated in the cleaning nozzle. The suction flow path part may further include the reinforcement portion configured to increase a thickness along a circumference of the suction flow path part located close to the brush driving part or constituting the protruding portions. Thus, an asymmetric load on the brush driving part may be corrected.

MODE FOR THE INVENTION

Figure 1:
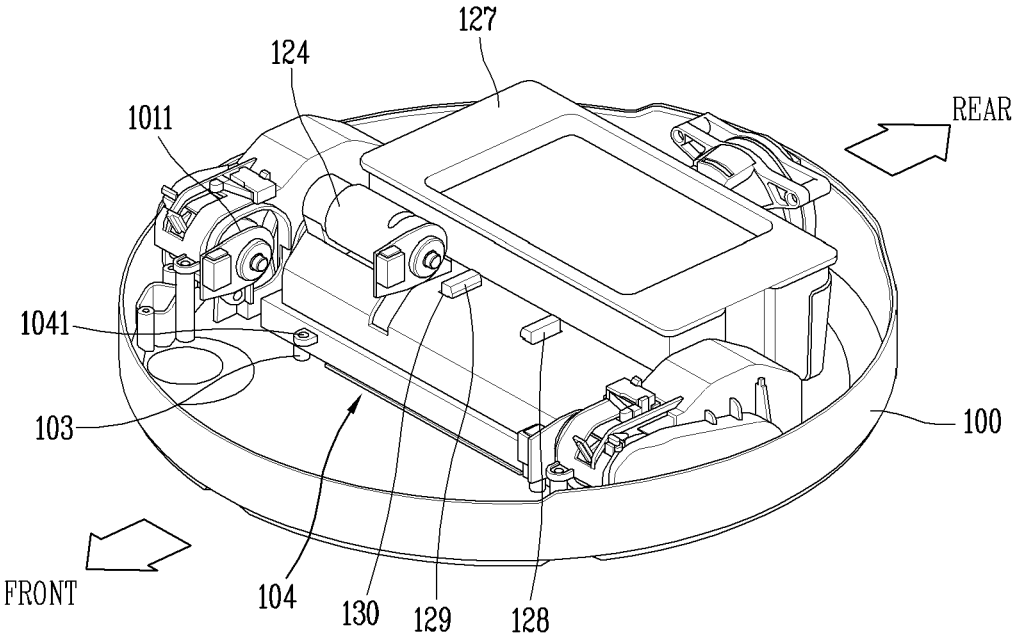
FIG. 1 is a perspective view illustrating a state in which a cleaning nozzle assembly is mounted inside a robot cleaner according to the present disclosure.

Hereinafter, embodiments disclosed herein will be described in detail with reference to the accompanying drawings, and the same or similar elements are designated with the same numeral references, regardless of the numerals in the drawings, and their redundant description will be omitted. In general, a suffix such as "module" and "unit" may be used to refer to elements or components. Use of such a suffix herein is merely intended to facilitate description of the specification, and the suffix itself is not intended to give any special meaning or function. In describing the present disclosure, if a detailed explanation for a related known technology or construction is considered to unnecessarily divert the gist of the present disclosure, such explanation has been omitted but would be understood by those skilled in the art. The accompanying drawings are used to help easily understand the technical idea of the present disclosure and it should be understood that the idea of the present disclosure is to not limited by the accompanying drawings. The idea of the present disclosure should be construed to extend to any alterations, equivalents and substitutes besides the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be connected with the another element or intervening elements may also be present. In contrast, when an element is referred to as being "directly connected with" another element, there are no intervening elements present.

A singular representation may include a plural representation unless it represents a definitely different meaning from the context.

Terms such as "include" or "has" are used herein and should be understood that they are intended to indicate an existence of several components, functions or steps, disclosed in the specification, and it is also understood that greater or fewer components, functions, or steps may likewise be utilized.

FIG. 1 is a perspective view illustrating a state in which an assembly of a cleaning nozzle 110 is mounted inside a robot cleaner according to the present disclosure.

Figure 2:
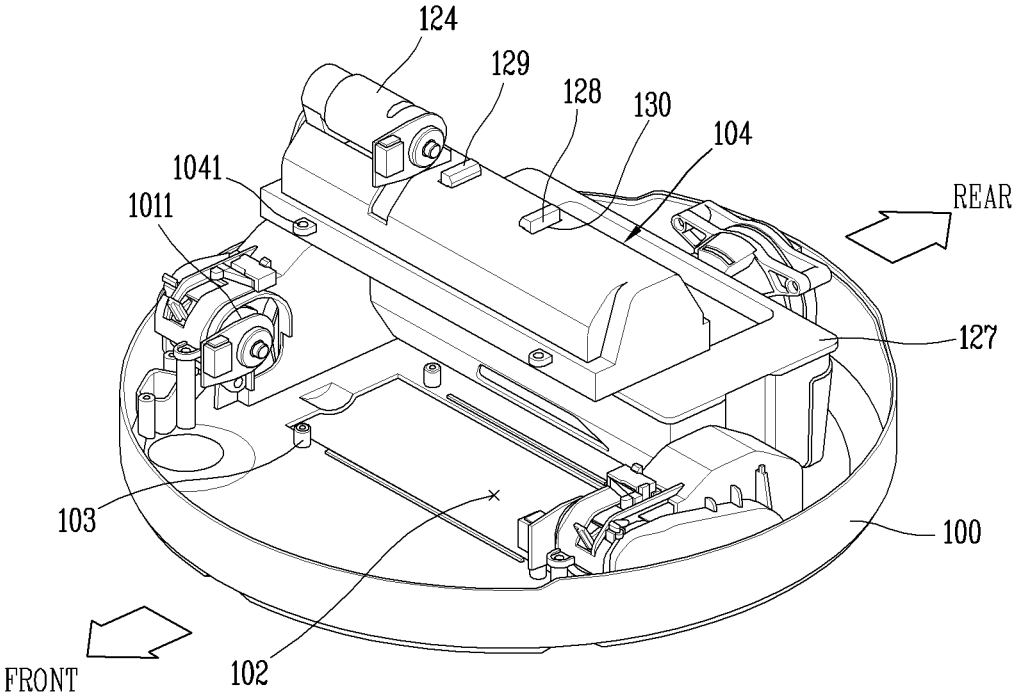
FIG. 2 is a conceptual view illustrating a state in which the cleaning nozzle assembly of FIG. 1 is disassembled.

FIG. 2 is a conceptual view illustrating a state in which the assembly of the cleaning nozzle 110 of FIG. 1 is disassembled.

Figure 3:
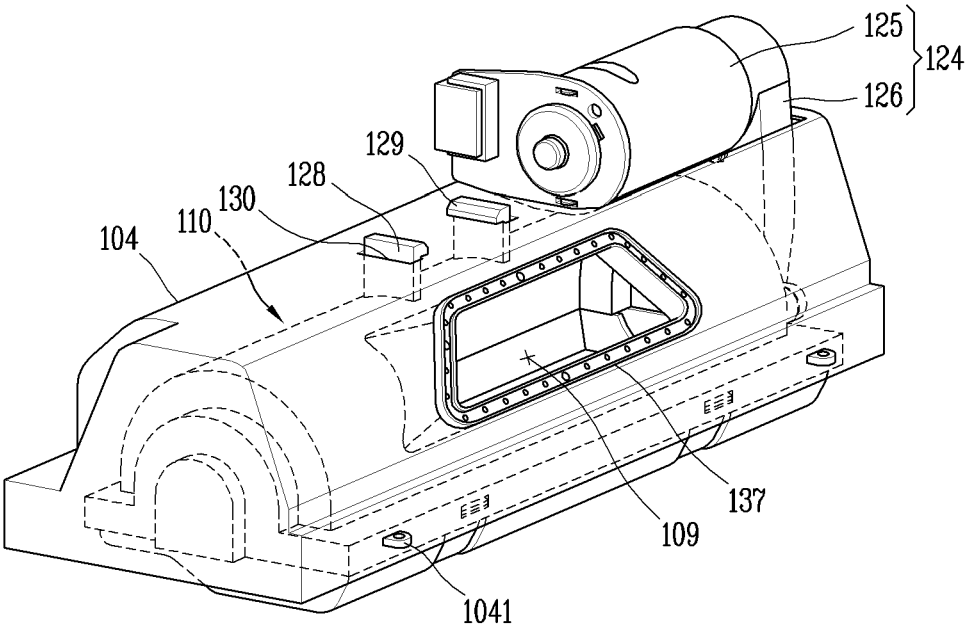
FIG. 3 is a rear perspective view illustrating the cleaning nozzle assembly of FIG. 1 viewed from a rear direction.

FIG. 3 is a rear perspective view illustrating the assembly of the cleaning nozzle 110 of FIG. 1 viewed from a rear direction.

Figure 4:
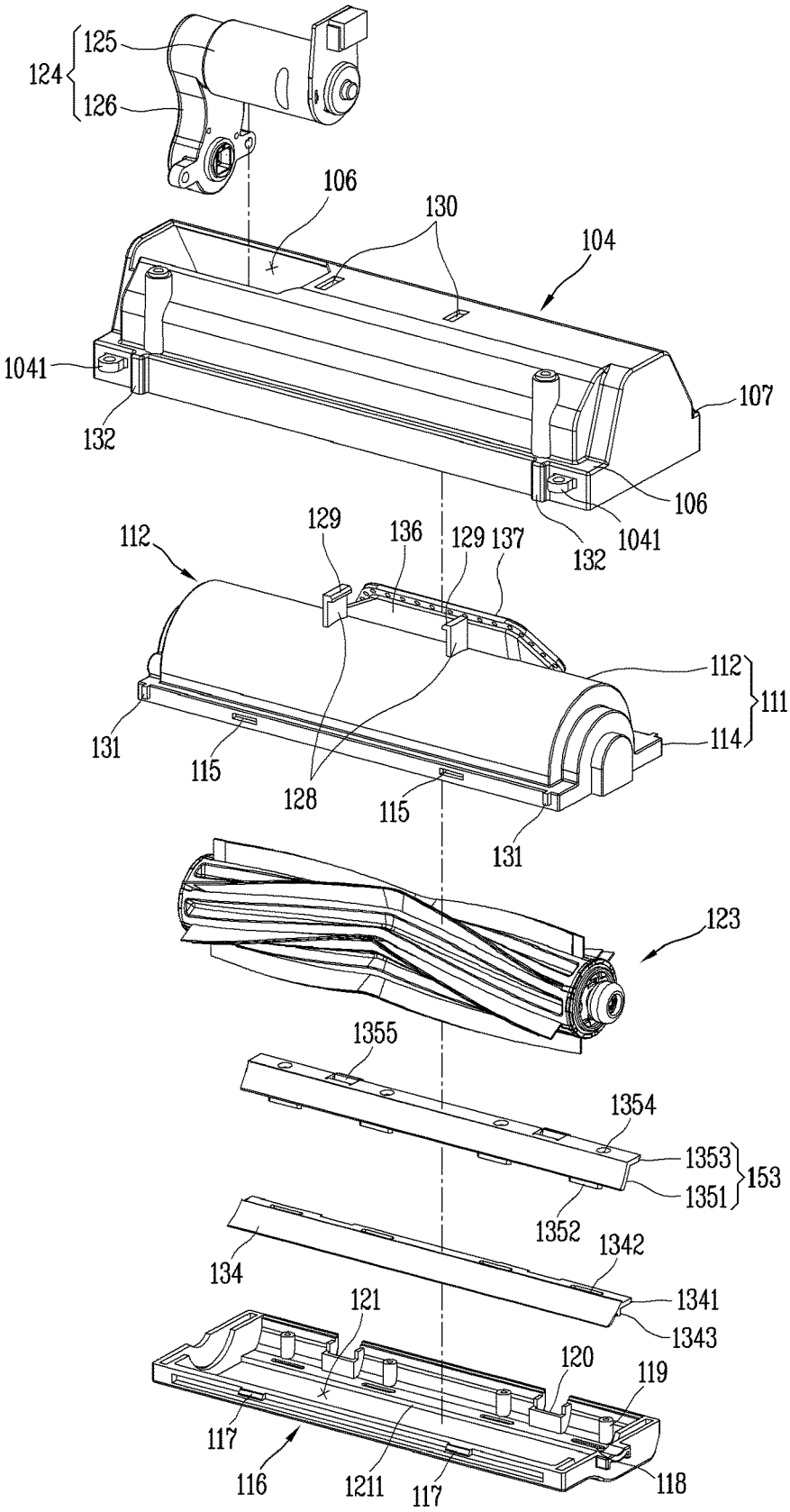
FIG. 4 is an exploded view illustrating a state in which the cleaning nozzle assembly of FIG. 3 is disassembled.

FIG. 4 is an exploded view illustrating a state in which the assembly of the cleaning nozzle 110 of FIG. 3 is disassembled.

Figure 5:
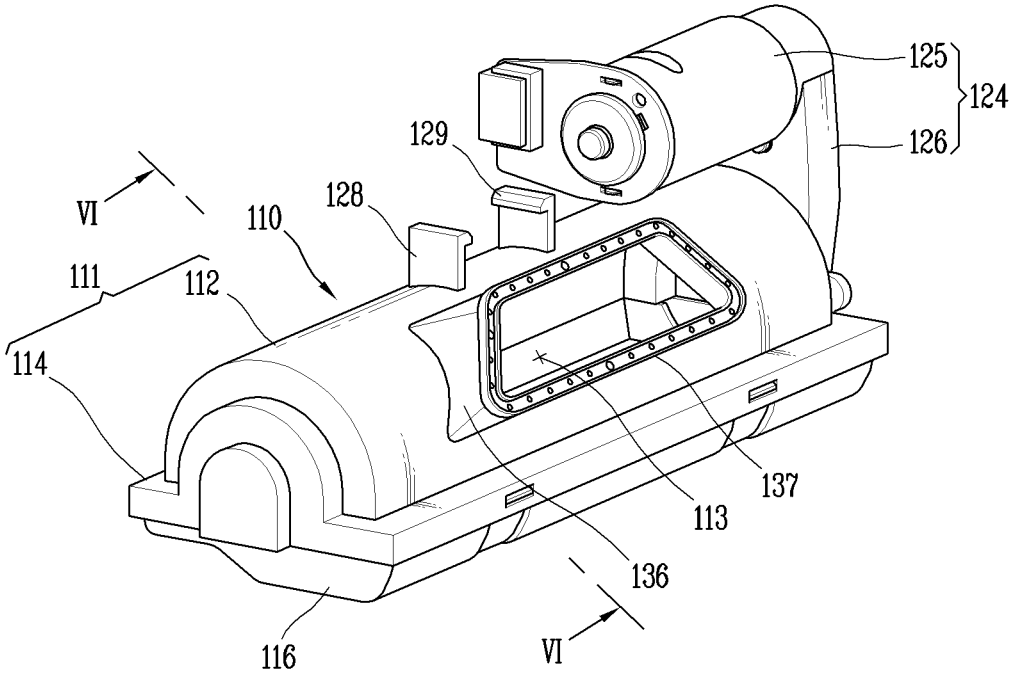
FIG. 5 is a conceptual view illustrating a cleaning nozzle of FIG. 4 viewed from a rear direction.

FIG. 5 is a conceptual view illustrating a state in which the cleaning nozzle 110 of FIG. 4 is viewed from a rear direction.

Figure 6:
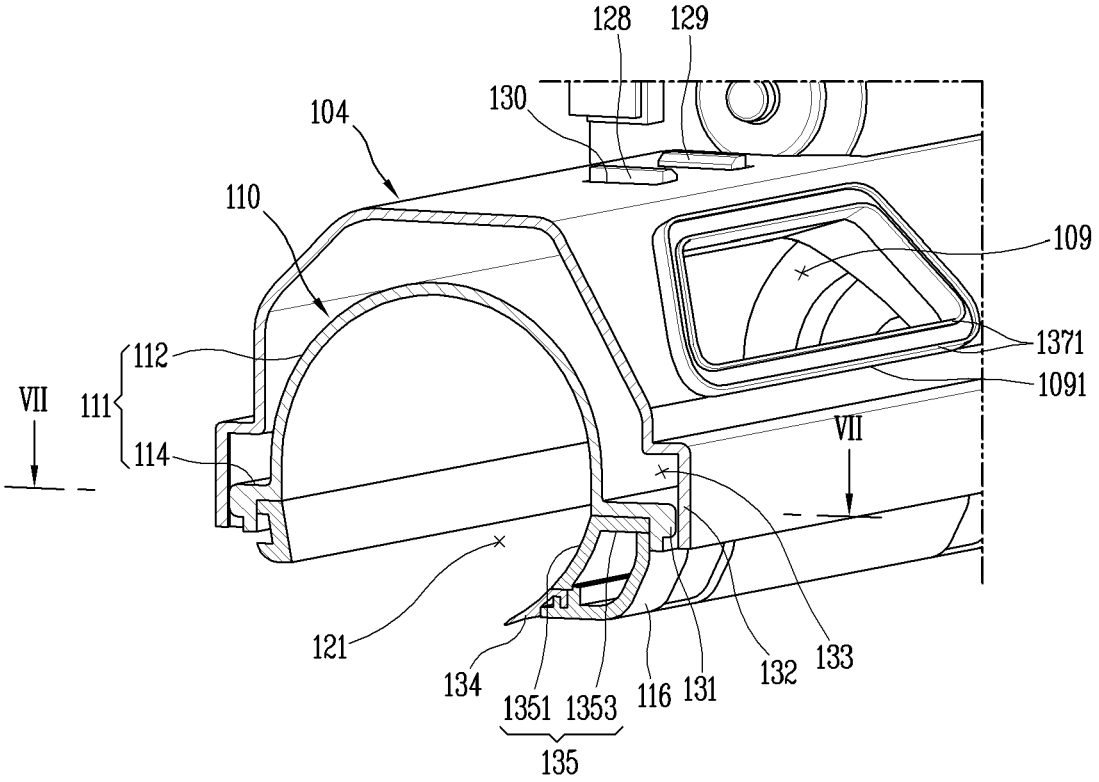
FIG. 6 is a cross-sectional view of FIG. 5 taken along a line VI-VI.

FIG. 6 is a cross-sectional view of FIG. 5 taken along a line VI-VI.

Figure 7:
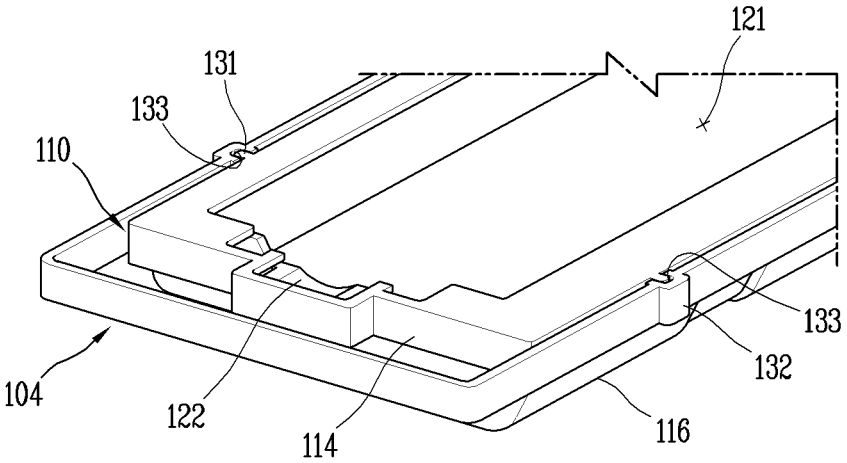
FIG. 7 is a cross-sectional view of FIG. 6 taken along a line VII-VII.

FIG. 7 is a cross-sectional view of FIG. 6 taken along a line VII-VII.

The robot cleaner is configured to perform a function of cleaning a floor while autonomously traveling in a certain area. Here, the cleaning of the floor may be understood as including suctioning foreign materials and dust on the floor or mopping the floor.

In this example, the robot cleaner is configured to perform a vacuum cleaning function of, while autonomously traveling in a certain area, sucking air from the floor and collecting dust by separating the dust with foreign materials from the sucked air.

The robot cleaner is configured to include a cleaner body 100. The cleaner body 100 provides an appearance of the robot cleaner. Various components including a control unit configured to control the robot cleaner are equipped with or mounted in the cleaner body 100.

In the cleaner body 100, a circuit substrate (not shown) constituting the control unit may be arranged. Various modules, for example, a brush module 123 or a mop module (not shown) may be detachably coupled to the cleaner body 100.

Driving wheels 101 (refer to FIG. 13) are provided on a lower surface of the cleaner body 100. The driving wheels 101 are configured to rotate by receiving driving power from a wheel driving motor 1011. A wheel driving motor 1011 may receive a control signal from the control unit to control driving of the wheel driving motor 1011.

The driving wheels 101 may be provided at both left and right sides on the lower surface of the cleaner body 100, respectively. The wheel driving motor 1011 may be connected to each of the driving wheels 101 for independent driving of each of the driving wheels 101.

The cleaner body 100 may move in a left, right, forward, or backward direction or rotate according to rotation of the driving wheels 101.

Auxiliary wheels 1012 (refer to FIG. 13) may be further provided on the lower surface of the cleaner body 100. The auxiliary wheels 1012 may be distinguished from the driving wheels 101 in that the auxiliary wheels 1012 only have a function of rolling on a floor.

The auxiliary wheels 1012 may support the cleaner body 100 together with the driving wheels 101. The auxiliary wheels 1012 are configured to assist in traveling of the cleaner body 100.

A plurality of the auxiliary wheels 1012 may be rotatably installed at respective centers of a front portion and a rear portion of the cleaner body 100 with reference to a center line in a side direction passing centers of a plurality of the driving wheels 101.

A battery (not shown) configured to supply power to the robot cleaner is mounted in the cleaner body 100. The battery may be configured to be rechargeable, and may be detachably attached to a lower surface portion of the cleaner body 100.

A sensing unit (not shown) may be arranged in a front portion of the cleaner body 100. The sensing unit may be positioned at a constant height from a front surface of the cleaner body 100.

The sensing unit may be configured to detect an obstacle, a geographic feature, etc. in front of the cleaner body 100 so that the cleaner body 100 does not collide with the obstacle.

When the robot cleaner is configured to perform a vacuum cleaning function, air including dust and foreign materials may be sucked through an opening portion 102 provided in the lower portion of the cleaner body 100.

The opening portion 102 may be provided to extend along a left/right direction with reference to a traveling direction of the cleaner body 100. The opening portion 102 may be provided to have a rectangular shape. The opening portion 102 may be provided to pass through the lower surface of the cleaner body 100 in an upward/downward direction.

A cleaning nozzle 110 configured to clean dust and foreign materials on a floor surface is provided inside the opening portion 102.

A nozzle accommodation unit 104 is provided in the opening portion 102 of the cleaner body 100. The nozzle accommodation unit 104 is mounted on the lower surface of the cleaner body 100 to cover the opening portion 102. The nozzle accommodation unit 104 may extend in a left/right direction with reference to the traveling direction of the cleaner body 100.

The nozzle accommodation unit 104 includes an accommodation space therein to accommodate the cleaning nozzle 110. A lower portion of the nozzle accommodation unit 104 is provided to open in a downward direction. The nozzle accommodation unit 104 is configured to cover an upper portion of the cleaning nozzle 110.

A plurality of bosses 103 may be arranged spaced apart from each other in a forward/backward direction and a left/right direction along a circumference of the opening portion 102 to fasten the nozzle accommodation unit 104 to the cleaner body 100. The plurality of bosses 103 may be provided in a cylindrical form to protrude in an upward direction.

Fastening grooves may be provided inside the plurality of bosses 103, respectively.

A plurality of fastening units 1041 may be arranged on a front end surface and a rear end surface of the nozzle accommodation unit 104, respectively, to be spaced apart from each other in a left/right longitudinal direction and protrude in a forward/backward direction. The fastening grooves may be provided inside the fastening units 1041.

Fastening members such as a screw pass through the fastening units 1041 to be fastened to the plurality of bosses 103 to thereby fasten the nozzle accommodation unit 104 to the cleaner body 100.

The cleaning nozzle 110 is configured to accommodate a brush module 123 therein. The cleaning nozzle 110 may be configured to include a nozzle cover 111 and a nozzle base 116.

The nozzle cover 111 may include a brush accommodation unit 112 and a flange unit 114.

The brush accommodation unit 112 may be provided to have an empty cylindrical form. The brush accommodation unit 112 includes an accommodation space therein to accommodate the brush module 123. A cylindrical structure of the brush accommodation unit 112 may minimize flow resistance of air sucked into the brush accommodation unit 112.

The brush module 123 includes a brush attached to an outer circumferential surface of a brush body having a cylindrical form and is configured to rotate the brush to sweep dust and foreign materials away from the floor.

A bottom portion of the brush accommodation unit 112 is open to expose the brush module 123 toward a floor surface through the bottom portion of the brush module 123. The brush module 123 may be rotatably mounted inside the cleaning nozzle 110.

A rotation shaft is provided to protrude at both ends of the brush module 123 in a direction of a shaft, and the brush module 123 is configured to rotate with reference to the rotation shaft.

A brush driving part 124 is mounted at an end of one side of the brush accommodation unit 112. The brush driving part 124 may include a brush motor 125 configured to drive the brush module 123, and a gear box 126 configured to deliver power of the brush motor 125 to the brush module 123.

The gear box 126 may include a plurality of gears therein. The gear box 126 may be configured to connect the brush motor 125 to the brush module 123.

The gear box 126 is arranged on a side surface of an end of the brush accommodation unit 112, and a side of the gear box 126 may be coupled to the rotation shaft of the brush module 123 to deliver power. The rotation shaft of the brush module 123 may pass through the end of the brush accommodation unit 112 to couple to the brush module 123.

The brush driving part 124 may be configured to protrude toward an outside of the nozzle accommodation unit 104. A through-portion 104 may be provided at one side of the nozzle accommodation unit 104 to be penetrated therethrough in an upward/downward direction. The nozzle accommodation unit 104 may be penetrated by the brush driving part 124 via the through-portion 108.

In this configuration, the brush driving part 124 may be equipped in one end portion of the cleaning nozzle 110, and pass through the through-portion 108 in the nozzle accommodation unit 104 to ascend or descend together with the cleaning nozzle 110.

The brush module 123 may rotate by receiving power from the brush driving part 124 to sweep dust and foreign materials away from the floor.

The dust and foreign materials in the air sucked through the brush module 123 are filtered and collected in a dust container 127. The air separated from the dust and foreign materials is discharged to outside of the cleaner body 100.

A suction flow path part 136 and an exhaust flow path (not shown) may be provided inside the cleaner body 100, the suction flow path part 136 being configured to guide air introduced via the opening portion 102 to the dust container 127, and the exhaust flow path being configured to guide flow of the air from the dust container 127 to outside of the cleaner body 100.

The suction flow path part 136 may extend to protrude from a rear portion of the brush accommodation unit 112 toward the dust container 127. The suction flow path part 136 may be connected to communicate with an inlet provided on a front surface of the dust container 127.

The dust container 127 may be detachably accommodated inside the cleaner body 100.

The dust container 127 may be provided with at least one of a filter and a cyclone for filtering the dust and foreign materials in the sucked air.

A flange unit 114 is provided in a lower end portion of the brush accommodation unit 112. The flange unit 114 is provided to protrude toward an outward direction along a circumference of a lower end of the brush accommodation unit 112. The flange unit 114 may be provided to have a rectangular shape.

A nozzle base 116 may be provided to correspond to the opening portion 102. The nozzle base 116 may be slightly smaller than the opening portion 102.

The nozzle base 116 may be configured to be fastened to a lower portion of the nozzle cover 111. The nozzle base 116 may be fastened to the flange unit 114. The nozzle base 116 may be arranged to overlap the flange unit 114 in an upward/downward direction.

The nozzle base 116 may be provided to have a closed-loop rectangular shape.

A suction inlet 121 may be provided in the nozzle base 116. The suction inlet 121 may be provided to communicate with the opening portion 102. Air outside a periphery of a cleaning surface on which the cleaner body 110 travels may be sucked into the brush accommodation unit 112 via the suction inlet 121.

A plurality of shaft support portions 112 may be provided to axially protrude from end portions of both sides of the nozzle base 116 in a longitudinal direction.

A plurality of shaft support portions 122 may be configured to support the rotation shaft protruding from both ends of the brush module 123. Both end portions of the rotation shaft may be rotatably supported by bearings, respectively. The shaft support portions 122 may be provided to have a form of a curved surface concavely in a downward direction.

A height of a front portion of the nozzle base 116 may be less than a height of a rear portion of the nozzle base 116.

A plurality of inclined surfaces may be provided in left and right side surface portions of the nozzle base 116. The inclined surfaces may be provided to be inclined downwardly from a front side surface portion to a rear side surface portion of the nozzle base 116. The inclined surfaces may be provided below the shaft support portions 122.

A lower end of a front portion of the nozzle base 116 and a lower end of the rear portion of the nozzle base 116, having a height difference therebetween, may be connected to each other by the inclined surfaces.

The rear portion of the nozzle base 116 may adhere to a floor surface, and a gap may be provided between a lower end of the front portion of the nozzle base 116 and the floor surface.

In this configuration, even when the rear portion of the nozzle base 116 adheres to the floor surface, air outside the front portion of the cleaner body 110 may be smoothly sucked into the suction inlet 121 via the gap.

To fasten the nozzle cover 111 to the nozzle base 116, a plurality of fastening projections 117 may be provided to protrude from a front surface of the front portion and a rear surface of the rear portion of the nozzle base 116 in a forward-backward direction.

Each of the fastening projections 117 may be provided to have a rectangular shape extending in a longitudinal direction of the nozzle base 116. The fastening projections 117 may be arranged spaced apart from each other in a left/right longitudinal direction of the nozzle base 116.

A plurality of fastening holes 115 may be provided in a front portion and a rear portion of the flange unit 114 to be penetrated through in a forward/backward direction. The plurality of fastening holes 115 may be provided to correspond to the plurality of fastening projections 117, respectively, so that the fastening projections 117 may match the fastening holes 115.

The fastening projections 117 may be provided to have a wedge form to be downwardly inclined in a forward/backward direction. Accordingly, when the nozzle base 116 is inserted into the flange unit 114, the fastening projections 117 may be easily assembled into the fastening holes.

A suction guide 134 may be mounted in a lower portion of the nozzle base 116.

The suction guide 134 functions as a dustpan configured to support and raise foreign materials swept away by the brush module 123 into the brush accommodation unit 112.

The suction guide 134 may be arranged in a rear portion of the nozzle base 116.

The suction guide 134 may be provided to extend in a left/right direction of the nozzle base 116 and have a form of a flat plate with a small thickness.

A front end portion of the suction guide 134 is provided to be inclined to be positioned at a lower height compared to a position of a rear end portion of the suction guide 134. This is to keep the front end portion of the suction guide 134 close to the floor surface as possible to thereby push and raise the front end portion above inside of the suction inlet 121.

A part of the suction guide 134 may be mounted into the nozzle base 116 to protrude in a downward direction via the suction inlet 121 of the nozzle base 116.

A fixing portion 1341 may be provided in a rear end portion of the suction guide 134 to protrude in a rear direction. The fixing portion 1341 may extend horizontally in a longitudinal direction of the suction guide 134.

A plurality of fitting holes 1342 may be provided in the fixing portion 1341 to be penetrated therethrough in an upward/downward direction. The fitting holes 1342 may be arranged spaced apart from each other in a longitudinal direction of the fixing portion 1341. The fitting holes 1342 may have a narrow width and be provided to extend in a direction in which the fixing portion 1341 extends.

A protruding end portion 1343 may be provided on a lower surface of the suction guide 134 to protrude in a downward direction. The protruding end portion 1343 may extend in a longitudinal direction of the suction guide 134.

A suction guide holder 135 is included inside the nozzle base 116 to fix the suction guide 134 to a rear portion inside the nozzle base 116.

The suction guide holder 135 may include a front holder portion 1351 and a rear holder portion 1353.

The front holder portion 1351 and the rear holder portion 1353 may have a certain angle therebetween and extend in a left/right side direction to have a length corresponding to the suction guide 134.

The front holder portion 1351 may be inclined downwardly from a front end portion of the rear holder portion 1353 to a rear end portion of the suction guide 134, and have a form of a curved surface.

The front holder portion 1351 may be arranged between a lower end of the brush accommodation unit 112 and a rear end of the suction guide 134. The brush accommodation unit 112, the front holder portion 1351, and the suction guide 134 may be arranged to overlap each other in a circumferential direction, and have a cross-sectional shape of one circular arc.

In this configuration, foreign materials swept away by the brush module 123 may be smoothly raised over inside of the suction inlet 121 along the suction guide 134 and the front holder portion 1351 without being caught.

A plurality of fixing holes 118 may be provided in a rear portion of the nozzle base 116 to be penetrated therethrough in an upward/downward direction. The fixing holes 118 may be arranged spaced apart from each other in a left/right side direction of the nozzle base 116. Each of the fixing holes 118 may be provided to have a narrow width and have a length extending in the left-right side direction.

A plurality of fixing projections 1352 may be provided to protrude from a lower surface of the front holder portion 1351 in a downward direction. The fixing projections 1352 may be arranged spaced apart from each other in a left/right side direction of the front holder portion 1351.

The rear holder portion 1353 may be arranged to overlap a part of the rear portion of the nozzle base 116, in which the fixing holes 118 are provided, in an upward/downward direction.

The fixing projections 1352, the fitting holes 1342, and the fixing holes 118 may be arranged to overlap each other in an upward/downward direction.

The fixing projections 1352 are fit and coupled to the fitting holes 1342 and the fixing holes 118 by penetrating therethrough. Thus, the front holder portion 1351 may push the fixing portion 1341 in the suction guide 134 in a downward direction to fix the fixing portion 1341 to the nozzle base 116.

A catching jaw 1211 may be provided at a rear end of the opening portion 102 of the nozzle base 116. The catching jaw 1211 may be arranged in front of the fixing holes 118. The catching jaw 1211 may constitute the rear end of the opening portion 102 and be arranged to have a vertical height along an upward direction.

A protruding end portion 1343 of the suction guide 134 is arranged on a front surface of the catching jaw 1211 to be in face contact with the front surface of the catching jaw 1211 to prevent a front end portion of the suction guide 134 from rotating in a downward direction or the fixing portion 1341 from being raised in an upward direction.

When, via the fitting holes 1342 and the fixing holes 118, the fixing projections 1352 are fit and coupled thereto, the fixing portion 1341 may be stably seated in and fixed to an inner side surface of the nozzle base 116.

The rear holder portion 1353 may be extend horizontally from a rear end the front holder portion 1351 to a rear direction.

A plurality of coupling holes 1354 may be provided to be penetrated therethrough in an upward/downward direction to fasten the rear holder portion 1353 to a rear portion of the nozzle base 116. The coupling holes 1354 may be arranged spaced apart from each other in a longitudinal direction of the rear holder portion 1353.

A plurality of coupling bosses 119 may be provided to protrude from the inner side surface of the nozzle base 116 in an upward direction to fasten the rear holder portion 1353 to the nozzle base 116. The coupling bosses 119 may be arranged spaced apart from each other in a longitudinal direction of the nozzle base 116.

The coupling holes 1354 and the coupling bosses 119 are arranged to overlap each other in an upward/downward direction.

A coupling member such as a screw passes through the coupling holes and is screw-fastened into a fastening groove provided in the coupling bosses 119 to fasten a rear holder portion 1353 to the nozzle base 116.

In this configuration, the suction guide holder 135 may securely fasten the suction guide 134 to the rear portion inside the nozzle base 116 using the fixing projections 1352 and the fixing holes 118.

In a state when the suction guide 134 is mounted in the suction inlet 121 of the nozzle base 116, the suction guide holder 135 may be fastened to the inside of the suction inlet 121 to thereby support the suction guide 134.

A plurality of correct position guides 120 may be configured to guide the suction guide holder 135 to a correct position in the nozzle base 116, and provided to protrude from the rear portion inside the nozzle base 116 in an upward direction.

The correct position guides 120 may be provided to have a structure in which a front portion and left and right sides are closed and a rear portion is open, that is, in a form of "E."

A plurality of correct guide accommodation holes 1355 may be provided to be penetrated therethrough in an upward/downward direction to accommodate the correct position guides 120 on a lower surface of the rear holder portion 1353.

The correct position guide accommodation holes 1355 and the correct position guides 120 may be arranged to overlap each other in an upward/downward direction.

As the correct position guides 120 are inserted into and match the correct position guide accommodation holes 1355, the coupling holes 1354 in the rear holder portion 1353 and the coupling bosses 119 in the nozzle base 116 may be provided to overlap each other in an upward/downward direction to thereby improve assembling property.

The cleaning nozzle 110 may be mounted to ascend or descend relative to the cleaner body 100, according to changes in a height of a floor while traveling from a hard floor 1 to a compressible floor such as a carpet 10, etc.

The cleaning nozzle 110 may perform an ascending or descending operation between a first position and a second position.

The first position is an initial position, and the initial position of the cleaning nozzle 110 may be set to fit the hard floor 1.

The second position is located higher than the first position. The second position is a position to which the cleaning nozzle 110 ascends according to a height of the compressible floor when the cleaner body 100 travels on the compressible floor such as the carpet 10, etc.

The cleaning nozzle 110 may be supported by a plurality of ascending/descending guides 128 and a plurality of support portions 130 to ascend or descend in a form of being hung onto an upper inner portion of the cleaner body 100.

For example, the cleaning nozzle 110 may be supported to ascend or descend in a form of being hung onto an upper portion of the nozzle cover 111.

The ascending/descending guides 128 may be provided to protrude from an upper portion of the brush accommodation unit 112 in an upward direction.

The ascending/descending guides 128 may be arranged spaced apart from each other in a longitudinal direction of the brush accommodation unit 112.

The ascending/descending guides 128 may be provided to have a rectangular shape having a narrow width and a height in a vertical direction greater than the width. The ascending/descending guides 128 may have a shape of a thin plate and extend in a forward/backward direction of the brush accommodation unit 112.

Each of the ascending/descending guides 128 may extend upwardly or downwardly in a vertical direction.

A thickness of the ascending/descending guides 128 may be provided to be smaller than a height of the ascending/descending guides 128 in the vertical direction and a width of the ascending/descending guides 128 in the left/right side direction.

The support portions 130 are provided in an upper portion of the nozzle accommodation unit 104. The support portions 130 may be provided in the upper portion of the nozzle accommodation unit 104 to be respectively penetrated therethrough in an upward/downward direction. The support portions 130 may be arranged to overlap the ascending/descending guides 128 in a protruding direction of the ascending/descending guides 128.

The support portions 130 may be provided to have a shape identical to that of the ascending/descending guides 128 to cover left, right, front, rear, and side surfaces of the ascending/descending guides 128.

The ascending/descending guides 128 may pass through the support portions 130 to be supported by the support portions 130 to move in an upward/downward direction.

A catching hook 129 is provided on an upper end portion of the ascending/descending guides 128 to protrude in an outward direction. The catching hook 129 is provided such that the upper end portion of the ascending/descending guides 128 is caught on the upper portion of the nozzle accommodation unit 104.

The catching hook 129 is provided to be caught on the support portions 130.

In this configuration, the ascending/descending guides 128 may pass through the support portions 130 to ascend from the first position (the initial position) to the second position (an ascended position). In this case, the support portions 130 guide ascending and descending operations of the ascending/descending guides 128.

In addition, when the ascending/descending guides 128 descend from the second position (the ascended position) to the first position (the initial position), the catching hook 129 are caught on the support portions 130. In this case, the catching hook 129 may limit the initial position (a lowest position) of the cleaning nozzle 110.

The support portions 130 may be positioned at an uppermost end of the nozzle accommodation unit 104 in an upward direction from a lower end of the nozzle accommodation unit 104.

However. a position of the support portions 130 is not limited thereto, and may be positioned at a constant height of the nozzle accommodation unit 104 in an upward direction from the lower end of the nozzle accommodation unit 104.

A position of the ascending/descending guides 128 is not limited to the uppermost end of the brush accommodation unit 112, and may be arranged in front and rear portions of the brush accommodation unit 112. Alternatively, the ascending/descending guides 128 may be provided on upper front and rear surfaces of the flange unit 114.

A plurality of supports may be provided to protrude in a forward/backward direction from a front portion and a rear portion of the nozzle accommodation unit 104, respectively.

The supports may be provided to protrude from the front portion and the rear portion of the nozzle accommodation unit 104, respectively.

A first support 106 among the supports may protrude toward a front portion of the nozzle accommodation unit 104.

A second support 107 among the supports may protrude toward a rear portion of the nozzle accommodation unit 104.

The first and second supports 106 and 107 may extend toward a left/right side direction of the nozzle accommodation unit 104.

Each of upper surfaces of the first and second supports 106 and 107 may be provided to have a shape of a flat surface at a constant height in an upward direction from a lower end of the nozzle accommodation unit 104.

To assist the ascending and descending operations of the cleaning nozzle 110, a plurality of auxiliary ascending/descending guides 131 may be included in the flange unit 114.

The auxiliary ascending/descending guides 131 may be provided to protrude from front and rear surfaces of the flange unit 114 in a forward/backward direction, respectively.

The auxiliary ascending/descending guides 131 may be arranged spaced apart from each other on front and rear surfaces of the flange unit 114 in a left/right side direction, respectively.

The auxiliary ascending/descending guides 131 may protrude vertically in an outward direction relative to front and rear surfaces of the flange unit 114, respectively. In addition, the auxiliary ascending/descending guides 131 may extend vertically in a direction of a height of the flange unit 114.

A plurality of guide accommodation units 132 may be provided to protrude from a front surface of the first support 106 and a rear surface of the second support 107, respectively. The guide accommodation units 132 may be arranged spaced apart from each other in a longitudinal direction of the supports.

Guide grooves 133 may be provided in the guide accommodation units 132 such that the auxiliary ascending/descending guides 131 may be slidably moved. The guide grooves 133 are provided to cover the auxiliary ascending/descending guides 131.

A vertical height of the guide grooves 133 may be provided to be greater than that of the auxiliary ascending/descending guides 131.

The guide accommodation units 132 may be provided such that upper ends of the guide grooves 133 are closed.

A vertical height of the guide grooves 133 may limit a maximum slidable height of the auxiliary ascending/descending guides 131.

A height of the upper ends of the guide grooves 133 may limit a maximum height of the auxiliary ascending/descending guides 131, as well as a maximum ascendable height of the ascending/descending guides 128 and a maximum ascendable height of the cleaning nozzle 110.

Hereinafter, functions and effects of the ascending/descending guides 128 and the auxiliary ascending/descending guides 131, each configured to guide ascending and descending operations of the cleaning nozzle 110 according to the present disclosure, are described.

Figure 8:
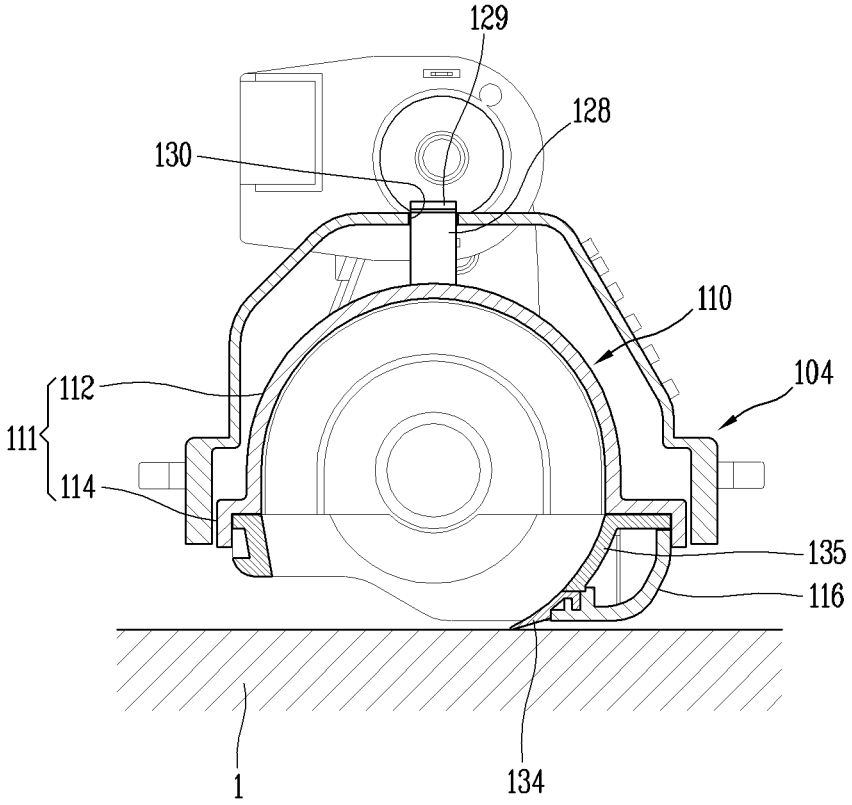
FIG. 8 is a conceptual view illustrating a position of an ascending/descending guide when the robot cleaner in the present disclosure travels on a hard floor.

FIG. 8 is a conceptual view illustrating a position of the ascending/descending guides 128 when the robot cleaner in the present disclosure travels on the hard floor 1.

Figure 9:
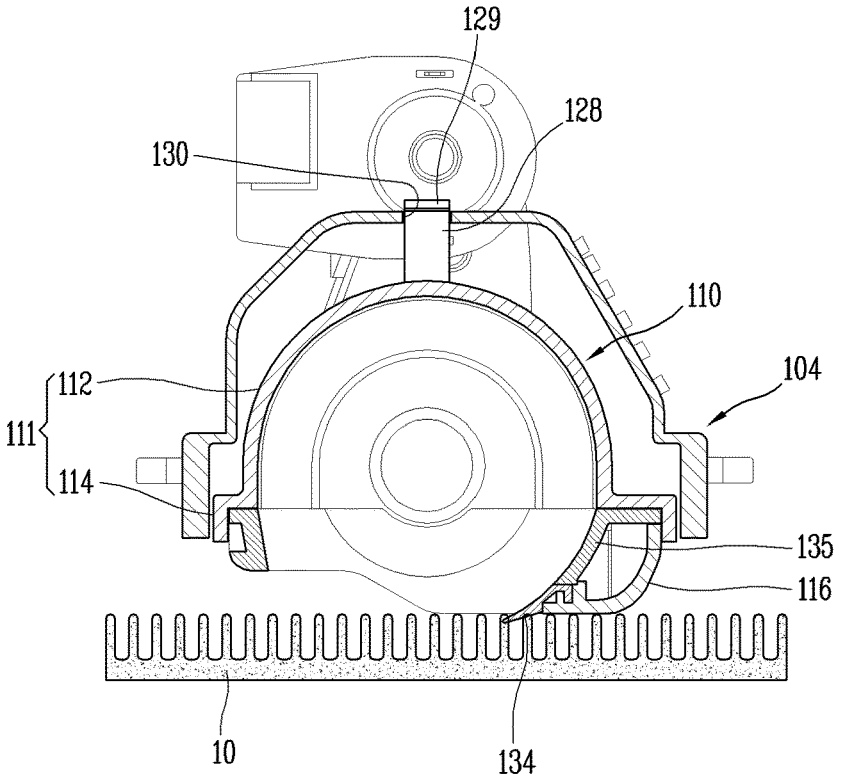
FIG. 9 is a conceptual view illustrating a position of the ascending/descending guide when the robot cleaner in the present disclosure travels on a compressible floor such as a carpet.

FIG. 9 is a conceptual view illustrating a position of the ascending/descending guides 128 when the robot cleaner in the present disclosure travels on a compressible floor such as the carpet 10, etc.

The robot cleaner may travel on the hard floor 1 or the compressible floor such as the carpet 10, etc.

When the robot cleaner travels on the hard floor 1, the floor 1 pressed by the driving wheels 101 has a same height as that of a cleaning surface cleaned by the cleaning nozzle 110.

However, when the robot cleaner travels on the compressible floor such as the carpet 10, etc., the compressible floor pressed by the driving wheels 101 has a height different from that of a cleaning surface cleaned by the cleaning nozzle 110.

Since the carpet 10 includes a textile material, as the driving wheels 101 press the carpet 10, a height of the cleaning surface is greater than that of a floor pressed by the driving wheels 101. A lower surface of the cleaning nozzle 110 is pressed in an upward direction according to the height of the cleaning surface.

When the robot cleaner passes through a boundary line between different floor environments to move from the hard floor 1 to the compressible floor, the cleaning nozzle 110 may rise according to pressing force of the cleaning surface.

The ascending/descending guides 128 positioned at an upper end of the nozzle cover 111 or the brush accommodation unit 112 guides an ascending operation of the cleaning nozzle 110.

The ascending/descending guides 128 may protrude and rise by passing through the support portions 130 penetrably provided at an uppermost end of the nozzle accommodation unit 104.

The support portions 130 may allow ascending of the ascending/descending guides 128, but limit left, right, forward, or backward movement of the ascending/descending guides 128.

Accordingly, the cleaning nozzle 110 may be supported by the ascending/descending guides 128 and the support portions 130 and rise from the initial position (the first position) to the second position that is located higher than the first position.

In addition, the auxiliary ascending/descending guides 131 may be provided in a left, right, front, or rear portion of the cleaning nozzle 110, the nozzle cover 111, or the flange unit 114 to guide a vertically ascending operation of the cleaning nozzle 110.

The auxiliary ascending/descending guides 131 may be arranged in a position lower than that of the ascending/descending guides 128 and assist the ascending/descending guides 128 in the cleaning nozzle 110.

The auxiliary ascending/descending guides 131 may protrude from front and rear surfaces of the flange unit 114, and be accommodated in the guide grooves 133 in the guide accommodation units 132 arranged in a left, right, front, or rear portion of the nozzle accommodation unit 104 and slidably arranged in an upward/downward direction to slide upwardly along the guide grooves 133.

The guide accommodation unit 132 is provided to have a vertical height greater than that of the auxiliary ascending/descending guides 131. As the upper ends of the guide grooves 133 provided in the guide accommodation units 132 are closed, a maximum ascending height of the auxiliary ascending/descending guides 131 may be limited.

On the other hand, when the robot cleaner passes through the boundary line between the different floor environments to move from the compressible floor to the hard floor 1, a height of the cleaning surface becomes same as that of the hard floor 1. Thus, as the pressing force on the cleaning surface is relieved, the cleaning nozzle 110 may descend to the original position.

In this case, as the catching hook 129 provided on the upper end of the ascending/descending guides 128 is caught on the support portions 130, the cleaning nozzle 110 is supported in a state of being hung onto the uppermost end of the nozzle accommodation unit 104. Thus, a lowest position of the cleaning nozzle 110 may be constantly maintained.

Figure 10:
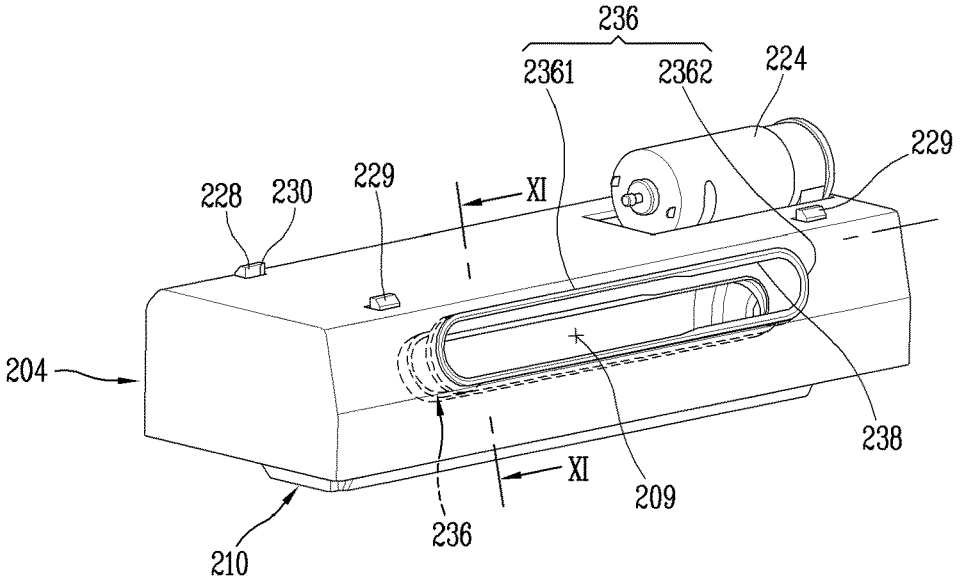
FIG. 10 is a conceptual view illustrating a cleaning nozzle according to another embodiment of the present disclosure.

FIG. 10 is a conceptual view illustrating a cleaning nozzle 210 according to another embodiment of the present disclosure.

Figure 11:
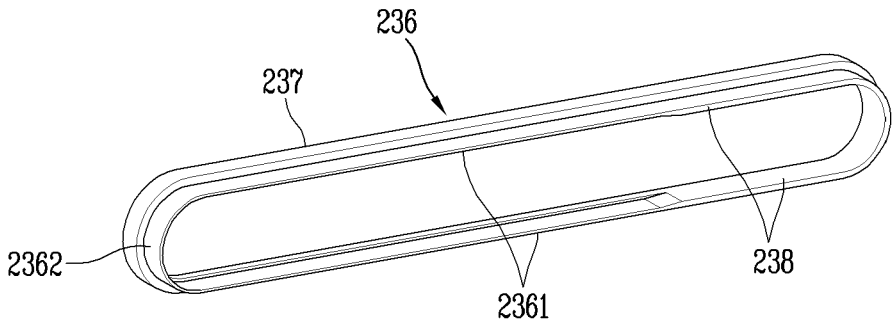
FIG. 11 is a cross-sectional view of FIG. 10 taken along a line XI-XI.

FIG. 11 is a cross-sectional view of FIG. 10 taken along a line XI-XI.

In the present embodiment, a plurality of ascending/descending guides 228 may extend to upwardly protrude from front and rear portions of the cleaning nozzle 210, respectively.

A plurality of support portions 230 may be provided on an upper surface of a nozzle accommodation unit 204 to be penetrated through in an upward/downward direction. The support portions 230 may be arranged spaced apart from each other in a forward/backward direction or a left/right side direction from the upper surface of the nozzle accommodation unit 2044.

The ascending/descending guides 228 may be supported to ascend or descend by passing through the support portions 230, respectively, to guide the cleaning nozzle 210 to ascend or descend.

Catching hooks 229 may be provided to protrude from upper portions of the ascending/descending guides 228 in an outward direction, respectively. The catching hooks 229 may be caught on the support portions 230 to limit a minimum descending height of the ascending/descending guides 228. The catching hook 229 may be supported in a state when the cleaning nozzle 210 is hung onto the upper side of the nozzle accommodation unit 204 in the cleaner body 100 using the ascending/descending guides 228.

A suction flow path part 236 may be provided to connect a discharge outlet 113 of the cleaning nozzle 210 to a communication part 209 of the nozzle accommodation unit 204.

Fastening flanges 237 may be included at one side and the other side of the suction flow path part 236, respectively. The fastening flanges 237 may further extend in an outward direction along a circumference of the suction flow path part 236 at both end portions of the suction flow path part 236.

The fastening flanges 237 may have a thickness greater than that of the suction flow path part 236.

A fastening flange 237 provided at one side of the suction flow path part 236 is fastened to the discharge outlet 113 (refer to FIG. 5) of the cleaning nozzle 210. Another fastening flange 237 provided at the other side of the suction flow path part 236 is fastened to the communication part 209 of the nozzle accommodation unit 204.

A flange fixing slot 1091 may be provided in a periphery of the communication part 209 to fasten the fastening flange 237 to the communication part 209. The flange fixing slot 1091 (refer to FIG. 6) may have a same shape as that of the fastening flanges 237.

Fixing projections 1371 (refer to FIG. 6) is provided to protrude from outer and inner side ends of the fastening flanges 237, respectively, and inserted into and combined with the flange fixing slot 1091 (refer to FIG. 6) to be fixed thereto.

Alternatively, fastening grooves may be provided concavely along a circumference of the fastening flanges 237 so that the fastening flanges 237 are inserted into and fixed to the discharge outlet 113 (refer to FIG. 5) or the communication part 209.

The suction flow path part 236 includes an elastic material, and may elastically support the cleaning nozzle 210 to ascend when the cleaning nozzle 210 ascends. The suction flow path part 236 may have an adjustable length, and be provided to be stretchable in a foldable form or a form of bellows.

The suction flow path part 236 may be provided in a form of a closed loop. The closed loop of the suction flow path part 236 may include a plurality of line portions 2361 arranged spaced apart from each other in a vertical direction and a plurality of curved portions 2362 arranged spaced apart from each other in a left/right side direction to connect the line portions 2361 to each other.

The line portions 2361 may be provided in a form of a flat surface. The curved portions 2362 may be provided in a form of a curved surface having a shape of a circular arc.

An end portion of the suction flow path part 236 may be connected to communicate with the discharge outlet 113 in the cleaning nozzle 210. The other end portion of the suction flow path part 236 may be connected to communicate with the communication part 209 in the nozzle accommodation unit 204.

Both of the end portions of the suction flow path part 236 may be fastened to the cleaning nozzle 210 and the nozzle accommodation unit 204, respectively, and provided to have a great thickness. Fastening grooves may be provided along a circumference of each of the both end portions of the suction flow path part 236. As the discharge outlet 113 of the cleaning nozzle 210 and the communication part 209 in the nozzle accommodation unit 204 fit into the fastening grooves, the suction flow path part 236 may be securely fastened to the cleaning nozzle 210 and the nozzle accommodation unit 204 to maintain air tightness.

The suction flow path part 236 may be configured to correct an asymmetric load on a brush driving part 224 mounted in an end portion at one side of the cleaning nozzle 210.

The suction flow path part 236 may be arranged inclined between a rear surface of the cleaning nozzle 210 and a rear surface of the nozzle accommodation unit 204.

The suction flow path part 236 may be configured to correct an asymmetric load on a brush driving part 224 mounted in the end portion at one side of the cleaning nozzle 210.

To do so, the suction flow path part 236 may include a flow path body and a reinforcement portion 238.

The reinforcement portion 238 may be provided integrally with the suction flow path part 236 and have a same elastic material as that of the suction flow path part 236.

The reinforcement portion 238 may have a great thickness in one section along an inner circumference of the flow path body In a beginning portion in which the reinforcement portion 238 is arranged, an inclination portion may be provided such that a thickness of the reinforcement portion 238 gradually increases.

The reinforcement portion 238 may be arranged adjacent to the brush driving part 224.

For example, when the suction flow path part 236 provided in a rear portion of the cleaning nozzle 210 is viewed from a rear direction, the brush driving part 224 may be arranged at a right end portion of the cleaning nozzle 210.

In the reinforcement portion 238, when two line portions 2361 facing each other in an upward/downward vertical direction of the suction flow path part 236 are divided into three sections, a section corresponding to ⅓ of whole lengths of the two line portions 2361 and arranged toward and adjacent to the brush driving part 224, and a right portion of the curved line portions 2362 connecting to the section may have a thickness greater than that of the other sections corresponding to ⅔ of the whole lengths of the two line portions 2361 and a left portion of the curved line portions 2362.

In this configuration, a strength at one side of the suction flow path part 236 arranged adjacent to the brush driving part 224 is increased by the reinforcement portion 238. Thus, the asymmetric load on the brush driving part 224 may be corrected. That is, the reinforcement portion 238 may minimize inclination of one side of the cleaning nozzle 210 in a downward direction compared to the other end of the cleaning nozzle 210 due to the asymmetric load on the brush driving part 224.

A description of other configurations is identical or similar to the embodiments described with reference to FIGS. 1 to 9, and thus, will not be provided here.

Figure 12:
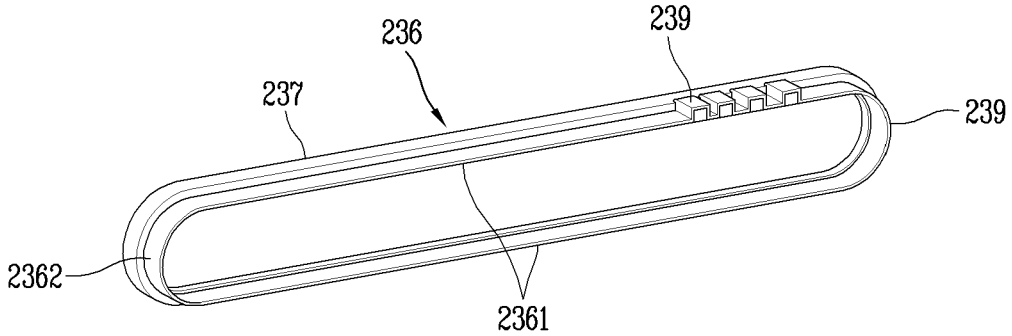
FIG. 12 is a conceptual view illustrating another aspect of a suction flow path part according to the present disclosure.

FIG. 12 is a conceptual view illustrating another aspect of the suction flow path part 236 according to the present disclosure.

In the present embodiment, the suction flow path part 236 includes a plurality of protruding portions 239 to correct an asymmetric load on the brush driving part 224. Thus, the suction flow path part 236 in the present embodiment is different from that described with reference to FIG. 11.

The protruding portions 239 may be provided in one section of an outside circumference of the suction flow path part 236. The protruding portions 239 may be arranged spaced apart from each other in a right ⅓ section of the line portions 2361 of the suction flow path part 236 to be adjacent to the brush driving part 224. Spaces between the protruding portions 239 may be provided to be different from each other.

For example, spaces between the protruding portions 239 may be narrow when the protruding portions 239 are far apart from the curved line portions 2362.

This is because the line portions 2361 of the suction flow path part 236 are affected by gravity more greatly than by support force of the curved line portions 2362 at a center portion of the line portions 2361 of the suction flow path part 236, compared to being at the curved line portions 2362. Thus, by providing many protruding portions 239 in a part of the line portions 2361 far apart from the curved line portions 2362, a reduction in the support force of the curved line portions 2362 may be compensated for.

Figure 13:
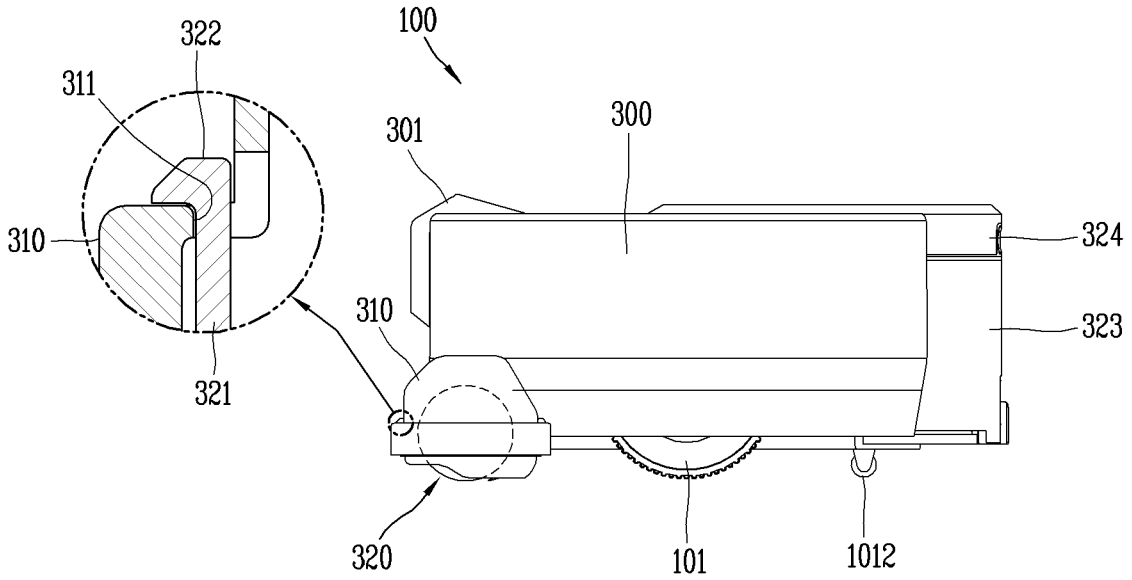
FIG. 13 is a conceptual view illustrating another aspect of the cleaning nozzle according to the present disclosure.

FIG. 13 is a conceptual view illustrating another aspect of a cleaning nozzle 320 according to the present disclosure.

In the present embodiment, a part of the cleaning nozzle 320 protrudes outwardly from a front surface of a cleaner body 300. Thus, the present embodiment is different from the embodiment described above with reference to FIGS. 1 to 9.

The cleaner body 300 may be provided to have a cylindrical form.

The cleaning nozzle 320 may be configured to protrude from a front surface of the cleaner body 300 in an outward direction.

A nozzle accommodation unit 310 configured to accommodate the cleaning nozzle 320 may be provided to protrude from the front surface of the cleaner body 300 in an outward direction. The nozzle accommodation unit 310 may extend to protrude from a lower front portion of the cleaner body 300 in a left/right side direction.

A sensing unit 301 may be provided to protrude from an upper front portion of the cleaner body 300 in an outward direction. The sensing unit 301 may be arranged to overlap the cleaning nozzle 320 in an upward/downward direction.

The sensing unit 301 may be arranged in an upper portion of the nozzle accommodation unit 310.

The sensing unit 301 is configured to detect an obstacle, a geographic feature, etc. in front of the nozzle accommodation unit 310 so that the nozzle accommodation unit 310 does not collide with the obstacle. The sensing unit 301 may be implemented using an ultrasound sensor, etc.

The cleaner body 300 may include a dust container accommodation unit 324. The dust container accommodation unit 324 may be detachably coupled to a dust container 323 configured to separate and collect dust from sucked air.

The dust container accommodation unit 324 may be provided in a rear portion of the cleaner body 300. The dust container accommodation unit 324 may have a form open toward the rear portion of the cleaner body 300. The dust container accommodation unit 324 may be provided to recess from the rear portion to a front portion of the cleaner body 300.

A part of the dust container 323 may be accommodated in the dust container accommodation unit 324, and the other part of the dust container 323 may be provided to protrude toward the rear portion of the cleaner body 300.

A cover of the dust container 323 may be provided in an upper portion of the dust container 323. A front end portion of the cover of the dust container 323 may be hinged to the dust container accommodation unit 324 in the cleaner body 300 so that a rear end portion of the cover of the dust container 323 may be configured to rotate in an upward/downward direction.

When the cover of the dust container 323 is arranged to cover an upper surface of the dust container 323, the dust container 323 may be prevented from being separated from the cleaner body 300 by the cover of the dust container 323.

The cleaning nozzle 320 is installed to ascend or descend in an upward/downward direction relative to the nozzle accommodation unit 310 in the cleaner body 300.

The cleaning nozzle 320 includes a plurality of ascending/descending guides 321 provided to protrude in an upward direction.

The nozzle accommodation unit 310 includes a plurality of support portions 331 configured to support upward/downward movement of the ascending/descending guides 321.

The support portions 331 are provided in front and rear portions of the nozzle accommodation unit 310, respectively, to be penetrated therethrough in an upward/downward direction so that the support portions 331 are penetrated by the ascending/descending guides 321 and slidably support the ascending/descending guides 321 in an upward/downward direction.

A catching hook 322 is provided on an upper end of the ascending/descending guides 321 to protrude in an outward direction. The catching hook 322 is provided to be caught on support portions 311 when the ascending/descending guides 321 are descending.

In this configuration, the catching hook 322 may limit a lowest position (an initial position) of the ascending/descending guides 321.

The cleaning nozzle 320 may include the plurality of auxiliary ascending/descending guides 131 (refer to FIGS. 6 and 7). The auxiliary ascending/descending guides 131 (refer to FIGS. 6 and 7) may protrude from the cleaning nozzle 320 in an outward direction. The auxiliary ascending/descending guides 131 may extend vertically in an upward/downward direction. The auxiliary ascending/descending guides 131 may be arranged below the ascending/descending guides 321.

The auxiliary ascending/descending guides 131 may be configured to vertically raise or lower the cleaning nozzle 320.

The nozzle accommodation unit 310 may include the plurality of guide accommodation units 132. The guide accommodation unit 132 (refer to FIGS. 6 and 7) may include the guide grooves 133 (refer to FIGS. 6 and 7) therein to support the auxiliary ascending/descending guides 131 to slide in an upward/downward direction. The guide accommodation unit 131 may be arranged below the support portions 311.

The ascending/descending guides 321 and the auxiliary ascending/descending guides 131 may be arranged in front and rear portions of the cleaning nozzle 320, respectively, to have the brush module 123 accommodated in the cleaning nozzle 320 arranged therebetween.

The support portions 311 and the guide accommodation unit 132 may be arranged in front and rear portions of the nozzle accommodation unit 310, respectively, to have the brush module 123 arranged therebetween.

Accordingly, according to the present disclosure, the plurality of ascending/descending guides 128, 228, or 321 are provided in an upper portion of the cleaning nozzle 110, 210, or 320 to protrude in an upward direction. The plurality of support portions 130, 230, or 311 are provided on an upper portion of the nozzle accommodation unit 104, 204, or 310 to be penetrated therethrough, the nozzle accommodation unit 104, 204, or 310 being configured to cover the upper portion of the cleaning nozzle 110, 210, or 320. The ascending/descending guides 128, 228, or 321 pass through the support portions 130, 230, or 311 to be supported by the support portions 130, 230, or 311 to ascend or descend. Thus, the cleaning nozzle 110, 210, or 320 may ascend or descend from the opening portion 102 opening downwardly in a low portion of the cleaner body 300, according to a height difference between floors. Accordingly, when the cleaner body 300 moves from a surface of the hard floor 1 to a compressible floor surface, a phenomenon in which the cleaning nozzle 110, 210, or 320 is caught on the compressible floor surface is minimized, and thus, travel performance may be improved. In addition, as a brush in the brush module 123 rotates in a state of rising above the compressible floor surface, rotation resistance of the brush module 123 is reduced, and thus, a load on the brush driving part 124 or 224 may be reduced. Power consumption of the brush driving part 124 or 224 may be reduced, and thus, allowable cleaning time may be extended.

In addition, as the catching hook 129, 229, or 322 are provided to protrude from upper end portions of the ascending/descending guides 128, 228, or 321 and be caught on the support portions 130, 230, or 311, the cleaning nozzle 110, 210, or 320 may be supported in a state of being hung onto the upper portion of the nozzle accommodation unit 104, 204, or 310 in the cleaner body 300. Accordingly, the catching hook 129, 229, or 322 may limit a lowest descending height of the cleaning nozzle 110, 210, or 320.

Further, the auxiliary ascending/descending guides 131 may be provided to protrude from front and rear surfaces of the cleaning nozzle 110, 210, or 320, respectively, to be arranged below the ascending/descending guides 128, 228, or 321. The guide accommodation units 132 may be provided to protrude from front and rear surface of the nozzle accommodation unit 104, 204, or 310, respectively, in an outward direction, to be arranged below the support portions 130,230,311. The auxiliary ascending/descending guides 131 may be slidably supported in an upward/downward direction along the guide grooves 133 provided inside the guide accommodation unit 132. Accordingly, the auxiliary ascending/descending guides 131 may slide upwardly or downwardly in a state of being accommodated in the guide accommodation unit 132 to stably support vertical ascending/descending of the cleaning nozzle 110, 210, or 320. In addition, the auxiliary ascending/descending guides 131 and the guide accommodation unit 321 may prevent twisting during the vertical ascending/descending of the cleaning nozzle 110, 210, or 320.

Further, an upper end portion of the guide accommodation unit 132 is provided to have a closed structure in which upper ends of the guide grooves 133 are closed. Thus, when upper end portions of the auxiliary ascending/descending guides 131 receive pressing force and rise due to a height of a floor, a maximum ascending height of the auxiliary ascending/descending guides 131 may be limited due to the closed structure of the guide accommodation unit 132.

The ascending/descending guides 128, 228, or 321 and the auxiliary ascending/descending guides 131, each configured to guide an ascending/descending operation of the cleaning nozzle 110, 210, or 320, may be arranged on an upper portion of the brush accommodation unit 112 arranged in an upper inner portion of the cleaner body 300 to minimize introduction of foreign materials. In addition, the support portions 130, 230, or 311 and the guide accommodation unit 132 are configured to support the ascending/descending guides 128, 228, or 321 and the auxiliary ascending/descending guides 131 to move upwardly or downwardly and have simple structures, respectively, which will greatly contribute to miniaturization of the robot cleaner and cost reduction.

Further, the suction flow path part 236 is configured to suck foreign materials, etc. swept away by the brush module 123, and extend to protrude from a rear portion of the cleaning nozzle 110, 210, or 320 to connect to the nozzle accommodation unit 104, 204, or 310. The suction flow path part 236 includes an elastic material, and may elastically support the cleaning nozzle 110, 210, or 320 configured to ascend/descend according to a height of a floor.

In addition, the brush driving part 124 or 224 is mounted in an end portion at one side of the cleaning nozzle 110, 210, or 320 to drive the brush module 123 accommodated in the cleaning nozzle 110, 210, or 320. The suction flow path part 236 may further include the reinforcement portion 238 for increasing a thickness along a circumference of the suction flow path part 236 located close to the brush driving part 124 or 224 or constituting the protruding portions 239. Thus, an asymmetric load on the brush driving part 124 or 224 may be corrected.

The invention claimed is:

1. A robot cleaner comprising:

a cleaner body equipped with a circuit substrate and a driving wheel of which driving is controlled by the circuit substrate;

a cleaning nozzle mounted inside an opening portion opening downwardly in a lower portion of the cleaner body, and configured to ascend or descend relative to the cleaner body according to changes in a height of a cleaning surface on which the cleaner body travels;

a plurality of ascending/descending guides comprised in the cleaning nozzle and configured to guide the ascending or the descending of the cleaning nozzle;

a plurality of support portions comprised in the cleaner body and configured to support the plurality of ascending/descending guides, respectively, so that the plurality of ascending/descending guides pass through the plurality of support portions, respectively, and move in an upward or downward direction; and a plurality of auxiliary ascending/descending guides comprised in the cleaning nozzle to be arranged below the plurality of ascending/descending guides, and configured to guide vertical ascending or descending of the cleaning nozzle.

2. The robot cleaner of claim 1, further comprising catching hooks provided to protrude from upper end portions of the plurality of ascending/descending guides, respectively, and be caught on the plurality of support portions, respectively, when the plurality of ascending/descending guides descend such that the cleaning nozzle is hung onto an upper portion of the cleaner body.

3. The robot cleaner of claim 1, further comprising a plurality of guide accommodation units comprised in the cleaner body, the plurality of guide accommodation units being in face-contact with both side surfaces of the plurality of auxiliary ascending/descending guides, and being configured to guide vertical ascending or descending of the plurality of auxiliary ascending/descending guides.

4. The robot cleaner of claim 3, wherein the cleaning nozzle comprises a brush accommodation unit configured to accommodate a brush module, and wherein the plurality of auxiliary ascending/descending guides are provided to protrude from an upper portion of the brush accommodation unit.

5. The robot cleaner of claim 1, wherein the cleaning nozzle comprises a brush module, and wherein the plurality of ascending/descending guides are provided protrude from front and rear portions of the cleaning nozzle in the upward direction, respectively, with the brush module interposed therebetween.

6. The robot cleaner of claim 1, wherein the cleaning nozzle comprises:

a nozzle base comprising a suction inlet communicating with the opening portion, and shaft support portions at both ends of the nozzle base, respectively, wherein the shaft support portions rotatably support a brush module exposed via the suction inlet in the downward direction; and a nozzle cover coupled to an upper portion of the nozzle base to cover the brush module.

7. The robot cleaner of claim 6, wherein the nozzle cover comprises:

a brush accommodation unit configured to cover and accommodate the brush module in a circumferential direction; and a flange unit extending along an edge of the brush accommodating unit and coupled to the nozzle base, wherein the plurality of ascending/descending guides are provided to protrude from an upper surface of the brush accommodation unit, and arranged spaced apart from each other in a forward/backward direction of the brush accommodation unit.

8. The robot cleaner of claim 1, wherein the plurality of ascending/descending guides are provided at left and right sides of the cleaning nozzle, respectively, and configured to guide end portions of the left and right sides of the cleaning nozzle to independently ascend or descend.

9. The robot cleaner of claim 1, further comprising a nozzle accommodation unit installed in the cleaner body to cover the cleaning nozzle and configured to accommodate the cleaning nozzle, wherein the plurality of support portions are provided in the nozzle accommodation unit to be penetrated in an upward/downward direction so that the plurality of support portions are penetrated by the plurality of ascending/descending guides in the upward direction, respectively.

10. The robot cleaner of claim 6, wherein the nozzle cover comprises:

a brush accommodation unit configured to cover and accommodate the brush module in a circumferential direction;

a flange unit extending along an edge of the brush accommodating unit and coupled to the nozzle base; and the plurality of auxiliary ascending/descending guides provided to protrude from a front surface of the flange unit, and configured to guide vertical ascending or descending of the cleaning nozzle.

11. The robot cleaner of claim 3, further comprising a nozzle accommodation unit installed in the cleaner body to cover the cleaning nozzle and configured to accommodate the cleaning nozzle, wherein the plurality of guide accommodation units comprise guide grooves into which the plurality of auxiliary ascending/descending guides slide, and are provided to protrude from front and rear surfaces of the nozzle accommodation unit, respectively, to cover the plurality of auxiliary ascending/descending guides.

12. The robot cleaner of claim 6, wherein the cleaning nozzle further comprises:

the brush module configured to sweep away foreign materials on the cleaning surface via the opening portion;

a suction guide mounted to be inclined downwardly in a lower portion of the nozzle base, and configured to receive and raise the foreign materials swept away by the brush module; and a suction guide holder coupled to a lower portion of the nozzle base to fix the suction guide, with the suction guide arranged between the lower portion of the nozzle base and the suction guide holder.

13. The robot cleaner of claim 1, further comprising:

a nozzle accommodation unit installed in the cleaner body to cover the cleaning nozzle;

a discharge outlet provided in a rear portion of the cleaning nozzle and configured to discharge foreign materials sucked via the opening portion;

a communication part provided in a rear portion of the nozzle accommodation unit to communicate with the discharge outlet; and a suction flow path part configured to communicate the discharge outlet to the communication part, and comprising an elastic material to elastically support the cleaning nozzle so that the cleaning nozzle may ascend or descend.

14. The robot cleaner of claim 13, wherein, when the cleaning nozzle rises due to the height of the cleaning surface, the suction flow path part elastically presses the cleaning nozzle to an original position of the cleaning nozzle.

15. The robot cleaner of claim 13, wherein the suction flow path part further comprises a fastening flange provided to protrude from an end portion of the suction flow path part in an outward direction along a circumferential direction and fastened to the communication part, and wherein the suction flow path part extends to protrude toward a rear direction from the discharge outlet.

16. The robot cleaner of claim 1, wherein the cleaning nozzle comprises:

a brush accommodation unit configured to accommodate a brush module configured to sweep away foreign materials on the cleaning surface via the opening portion; and a brush driving part mounted in an end portion of one side of the brush accommodation unit, and configured to rotate the brush module.

17. The robot cleaner of claim 16, further comprising a nozzle accommodation unit installed in the cleaner body to cover the cleaning nozzle and configured to accommodate the cleaning nozzle, wherein the nozzle accommodation unit further comprises a through-portion penetrated by the brush driving part so that the brush driving part protruding from the end portion of the brush accommodation unit toward outside of the nozzle accommodation unit may ascend or descend with the cleaning nozzle.

18. The robot cleaner of claim 16, wherein the cleaning nozzle comprises a suction flow path part extending to protrude from a discharge outlet of the brush accommodation unit in a rear direction to discharge the foreign materials, and configured to elastically support the cleaning nozzle to correct an asymmetric load on the brush driving part.

19. The robot cleaner of claim 18, wherein the suction flow path part is provided in a form of a closed loop.

20. The robot cleaner of claim 18, further comprising a reinforcement portion provided such that a thickness is further increased along an inner circumference of a section of the suction flow path part, wherein the suction flow path part comprises an elastic material.

21. The robot cleaner of claim 18, further comprising a plurality of reinforcement ribs arranged spaced apart from each other along a surface of an outer circumference of a section of the suction flow path part, and provided to protrude in an outward direction, wherein the suction flow path part comprises an elastic material.

22. A robot cleaner comprising:

a cleaner body equipped with a circuit substrate and a driving wheel of which driving is controlled by the circuit substrate;

a cleaning nozzle mounted inside an opening portion opening downwardly in a lower portion of the cleaner body, and configured to ascend or descend relative to the cleaner body according to changes in a height of a cleaning surface on which the cleaner body travels;

a nozzle accommodation unit installed in the cleaner body to cover an upper portion of the cleaning nozzle;

a brush module mounted to be accommodated in the cleaning nozzle;

a brush driving part mounted in an end portion of one side of the cleaning nozzle and configured to drive the brush module;

a suction flow path part connecting the cleaning nozzle to the nozzle accommodation unit to suck foreign materials swept away by the brush module, and configured to elastically support the cleaning nozzle to ascend or descend and correct an asymmetric load on the brush driving part, a plurality of ascending/descending guides comprised in the cleaning nozzle and configured to guide the ascending or the descending of the cleaning nozzle; and a plurality of auxiliary ascending/descending guides comprised in the cleaning nozzle to be arranged below the plurality of ascending/descending guides, and configured to guide vertical ascending or descending of the cleaning nozzle.

* * * * *